US008893607B2

(12) United States Patent
Audibert et al.

(10) Patent No.: US 8,893,607 B2
(45) Date of Patent: Nov. 25, 2014

(54) TRIGGER AND HAMMER FOR AUTOMATIC AND SEMI-AUTOMATIC RIFLES

(75) Inventors: Kevin Audibert, Wolcott, CT (US); Kevin Langevin, Berlin, CT (US)

(73) Assignee: Colt's Manufacturing Company LLC, West Hartford, CT (US)

( * ) Notice: Subject to any disclaimer, the term of this patent is extended or adjusted under 35 U.S.C. 154(b) by 193 days.

(21) Appl. No.: 12/898,474

(22) Filed: Oct. 5, 2010

(65) Prior Publication Data

US 2011/0079137 A1 Apr. 7, 2011

Related U.S. Application Data

(60) Provisional application No. 61/248,789, filed on Oct. 5, 2009.

(51) Int. Cl.
*F41A 5/00* (2006.01)
*F41A 19/12* (2006.01)
*F41A 19/10* (2006.01)

(52) U.S. Cl.
CPC ..... *F41A 19/12* (2013.01); *F41A 19/10* (2013.01)
USPC ..... 89/136; 89/139; 42/69.01

(58) Field of Classification Search
USPC ..... 42/69.01, 69.02, 69.03; 89/136, 139, 89/132, 144, 146, 147
See application file for complete search history.

(56) References Cited

U.S. PATENT DOCUMENTS

| | | | | |
|---|---|---|---|---|
| 3,183,616 | A | 5/1965 | W.L. Gandy | |
| 3,292,492 | A * | 12/1966 | Sturtevant | 89/128 |
| 4,448,109 | A | 5/1984 | Johnson | |
| 4,937,964 | A | 7/1990 | Crandall | |
| 5,115,588 | A | 5/1992 | Bronsart et al. | |
| 5,187,312 | A | 2/1993 | Osborne | |
| 5,487,233 | A | 1/1996 | Jewell | |
| 5,501,134 | A | 3/1996 | Milazzo et al. | |
| 5,623,114 | A | 4/1997 | Soper | |
| 5,760,328 | A | 6/1998 | Robbins | |
| 5,881,485 | A * | 3/1999 | Milazzo | 42/70.08 |
| 5,924,231 | A | 7/1999 | Kidd | |
| 6,131,324 | A | 10/2000 | Jewell | |
| 6,722,072 | B1 | 4/2004 | McCormick | |
| 6,772,548 | B1 | 8/2004 | Power | |
| 7,162,824 | B1 | 1/2007 | McCormick | |
| 7,293,385 | B2 | 11/2007 | McCormick | |
| 7,331,136 | B2 | 2/2008 | Geissele | |
| 7,421,937 | B1 | 9/2008 | Gangl | |
| 7,600,338 | B2 * | 10/2009 | Geissele | 42/69.03 |
| 2005/0241470 | A1 | 11/2005 | Hochstrate et al. | |
| 2007/0051236 | A1 | 3/2007 | Groves et al. | |
| 2009/0183414 | A1 | 7/2009 | Geissele | |
| 2009/0188145 | A1 | 7/2009 | Fluhr et al. | |
| 2010/0186277 | A1 | 7/2010 | Beckmann | |
| 2011/0079137 | A1 * | 4/2011 | Audibert et al. | 89/136 |

* cited by examiner

*Primary Examiner* — Daniel J Troy
(74) *Attorney, Agent, or Firm* — Cantor Colburn LLP

(57) ABSTRACT

An automatic or semi-automatic firearm including a trigger having a frame, at least one trigger sear extending from the frame, and a hammer having a hammer pivot axis, a head and at least one hammer sear disposed on a lateral side of the hammer between the hammer pivot axis and the head, wherein the frame includes a pivot axis and the at least one trigger sear includes a trigger sear surface, the at least one trigger sear extending from the frame such that the at least one trigger sear engages a corresponding one of the at least one hammer sear.

15 Claims, 11 Drawing Sheets

TRIGGER AND HAMMER FOR AUTOMATIC AND SEMI-AUTOMATIC RIFLES

CROSS-REFERENCE TO RELATED APPLICATIONS

This application claims the benefit of U.S. Provisional Patent Application No. 61/248,789 filed on Oct. 5, 2009, the disclosure of which is incorporated by reference herein in its entirety.

BACKGROUND

1. Field

The exemplary embodiments generally relate to a firearm and, more particularly, to fire control systems for a firearm.

2. Brief Description of Related Developments

Generally shooters want to be able to discharge a firearm by exerting as little force as possible on the trigger so that there is minimal perceptible movement of the trigger. The more force and perceived motion required to pull or actuate the trigger, the harder it is to accurately hit the target since it is harder to determine when the firearm will discharge. Also a hard pull on the trigger may cause the jarring of the firearm affecting the accuracy of the shooter.

To reduce the perceived movement of the trigger, two-stage triggers have been developed to allow an initial long movement of the trigger to take up most of the trigger pull and provide the shooter with an indication that the trigger is about to be actuated. A second short movement of the trigger actuates the trigger and discharges the firearm. Conventional two-stage triggers utilize the trigger sear and the disconnect to provide the two stage operation of the trigger. For example, in a first stage of operation the trigger is pulled so the trigger sear slides most of the way off of the hammer sear until the disconnect contacts the hammer. A spring provided under the disconnect causes the disconnect to press against the hammer to increase the amount of force required to actuate the trigger during the second stage of operation. These conventional two-stage triggers allow for adjusting the disconnect spring, however this results in an increase of the overall force required to actuate the trigger.

It would be advantageous to have a trigger that enhances feedback or "feel" to the user during pulling of the trigger from battery, and yet reduces trigger travel for hammer release and discharging of a firearm. It would also be advantageous to be able to adjust the force required to actuate a two-stage trigger while maintaining an overall force at a predetermined value.

BRIEF DESCRIPTION OF THE DRAWINGS

The foregoing aspects and other features of the disclosed embodiments are explained in the following description, taken in connection with the accompanying drawings, wherein.

DETAILED DESCRIPTION OF THE EXEMPLARY EMBODIMENT(S)

Figure 1:
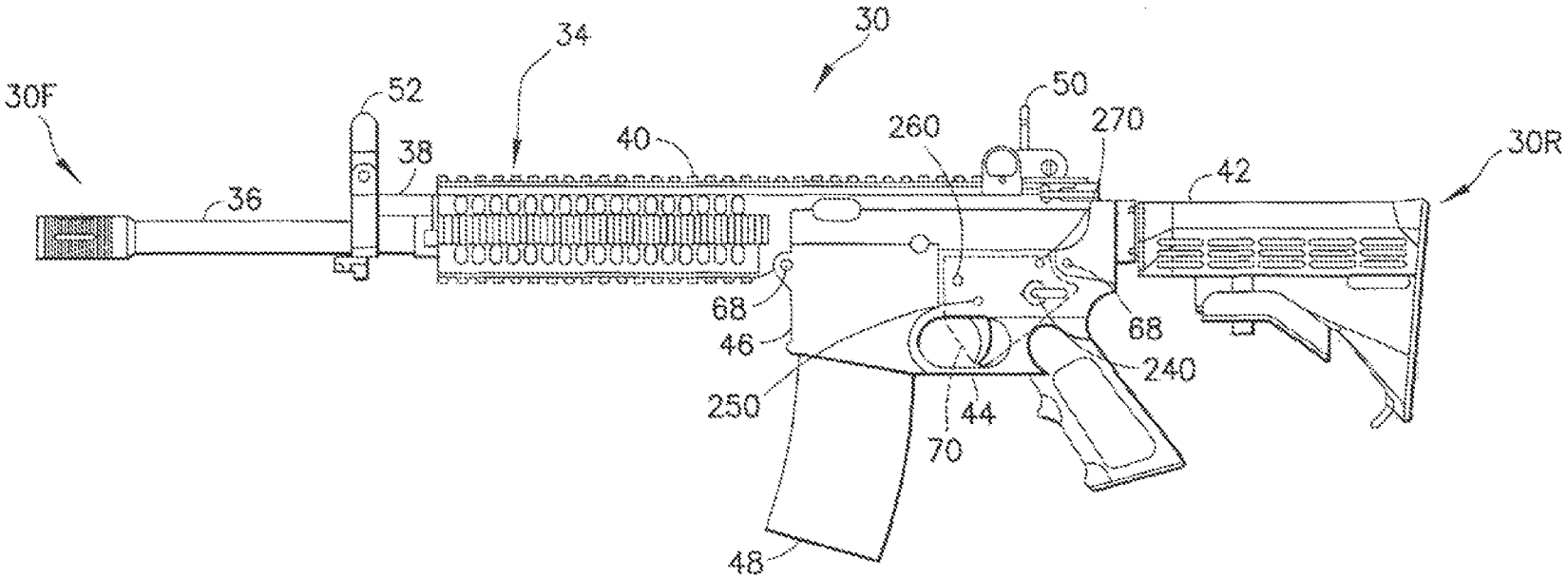
FIG. 1 is a schematic illustration of a firearm incorporating features of an exemplary embodiment.

Referring to FIG. 1, there is shown, a side elevation view of an automatic firearm 30 capable of automatic or semiautomatic fire incorporating features in accordance with an exemplary embodiment of the present invention. Although the disclosed embodiments will be described with reference to the drawings, it should be understood that the disclosed embodiments can be embodied in many alternate forms. In addition, any suitable size, shape or type of elements or materials could be used.

Firearm 30 may be a rifle or carbine with a direct gas impingement operating system, like examples, such as the M4 or M16 rifles available from Colt Defense, LLC, similar commercial variants thereof and may have features as disclosed in U.S. patent application Ser. No. 11/231,063 filed Sep. 19, 2005, U.S. patent application Ser. No. 11/352,036 filed Feb. 9, 2006 or U.S. patent Application No. 60/772,494 filed Feb. 9, 2006 all of which are hereby incorporated herein by reference in their entirety. Firearm 30 is illustrated as generally having a black rifle configuration. The black rifle configuration being the family of rifles developed by Eugene Stoner, for example, such as an M4 or M16 automatic firearm configuration. However, the features of the disclosed embodiments, as will be described below, are equally applicable to any desired type of automatic firearm. Firearm 30 may have features such as disclosed in U.S. patent application Ser. No. 11/672,189 filed Feb. 7, 2007, and U.S. patent application Ser. No. 11/869,676 filed Oct. 9, 2007, all of which are hereby incorporated by reference herein in their entirety. Firearm 30 may have operational features such as disclosed in U.S. Pat. Nos. 5,726,377, 5,760,328, 4,658,702, 4,433,610, United States Non Provisional patent application Ser. No. 10/836,443 filed Apr. 30, 2004, and U.S. Provisional Patent Application 60/564,895 filed Apr. 23, 2004, all of which are hereby incorporated by reference herein in their entirety. The firearm 30 and its sections described in greater detail below is merely exemplary. In alternate embodiments the firearm 30 may have other sections, portions or systems. The firearm 30 may have an upper receiver section 34 a barrel 36, gas piston system 38, and hand guard 40. In one embodiment, rifle 30 may have receiver 34 having an integral hand guard portion with barrel 36 removably connected to receiver 34 as described in U.S. patent application Ser. No. 11/672,189 filed Feb. 7, 2007, the disclosure of which is incorporated herein by reference in its entirety. In alternate embodiments the hand guard 40 may be separate from but coupled to the upper receiver 34 and/or barrel 36 in any suitable manner. The hand guard section may have features such as disclosed in U.S. Pat. Nos. 4,663,875 and 4,536,982, both of which are hereby incorporated by reference herein in their entirety. Hand guard section of upper receiver section 34 may be configured to support such rails as a "Picatiny Rail" configuration as described in Military Standard 1913, which is hereby incorporated by reference herein in its entirety. The rails may be made from any suitable material such as hard coat anodized aluminum as an example. A rear sight assembly is provided and mounted to upper receiver section 13. In alternate embodiments, the firearm may have an indirect gas operating system or gas tube operating system. Further, in alternate embodiments, the firearm may have neither a piston nor gas operating system and may rely on recoil action to cycle the weapon, for example, in semi-automatic mode. Here, the gas operated linkage actuating the bolt carriage in the upper receiver may be replaced by a gas tube. Firearm may also incorporate stock 42, lower receiver 44, magazine well 46, clip or magazine 48 and rear and front sights 50, 52, fire control selector 240, trigger 200 (FIG. 2), a bolt assembly 570 (FIG. 5A) and ejection port (not shown). The lower receiver 44 is removably joined to the upper receiver 34 by, for example, pins 68. Upper receiver 34 having barrel 36, lower receiver 44 and magazine well 46 may be modular and configurable such that firearm 30 comprises a modular rifle design. Further, the hand guard, and accessory mounting rails thereon, may be integral with the upper receiver and the integral upper receiver, hand guard and mounting rails may be of unitary construction. In alternate embodiments, the upper receiver and hand guard may be separate.

The lower receiver 44 is configured to at least partially house fire control group 70. Also referring to FIG. 2 in one exemplary embodiment the fire control group 70 includes trigger 200, trigger spring 200S, disconnect 210, hammer 220, hammer spring (not shown), auto-sear 230, auto-sear spring 230S and a selector 240. It is noted that the components of fire control group 70 are merely exemplary and in alternate embodiments the fire control group may include any suitable components for allowing the firearm 30 to be placed in a safe mode and operate in one or more of, for example, an automatic mode, a burst mode, or a semi-automatic/single shot mode. The trigger 200 is pivotally secured within the lower receiver 44 by trigger pin 250. The hammer 220 is pivotally secured within the receiver section 44 by hammer pin 260 and the auto-sear is pivotally secured within the lower receiver 44 by auto-sear pin 270.

Figure 3:
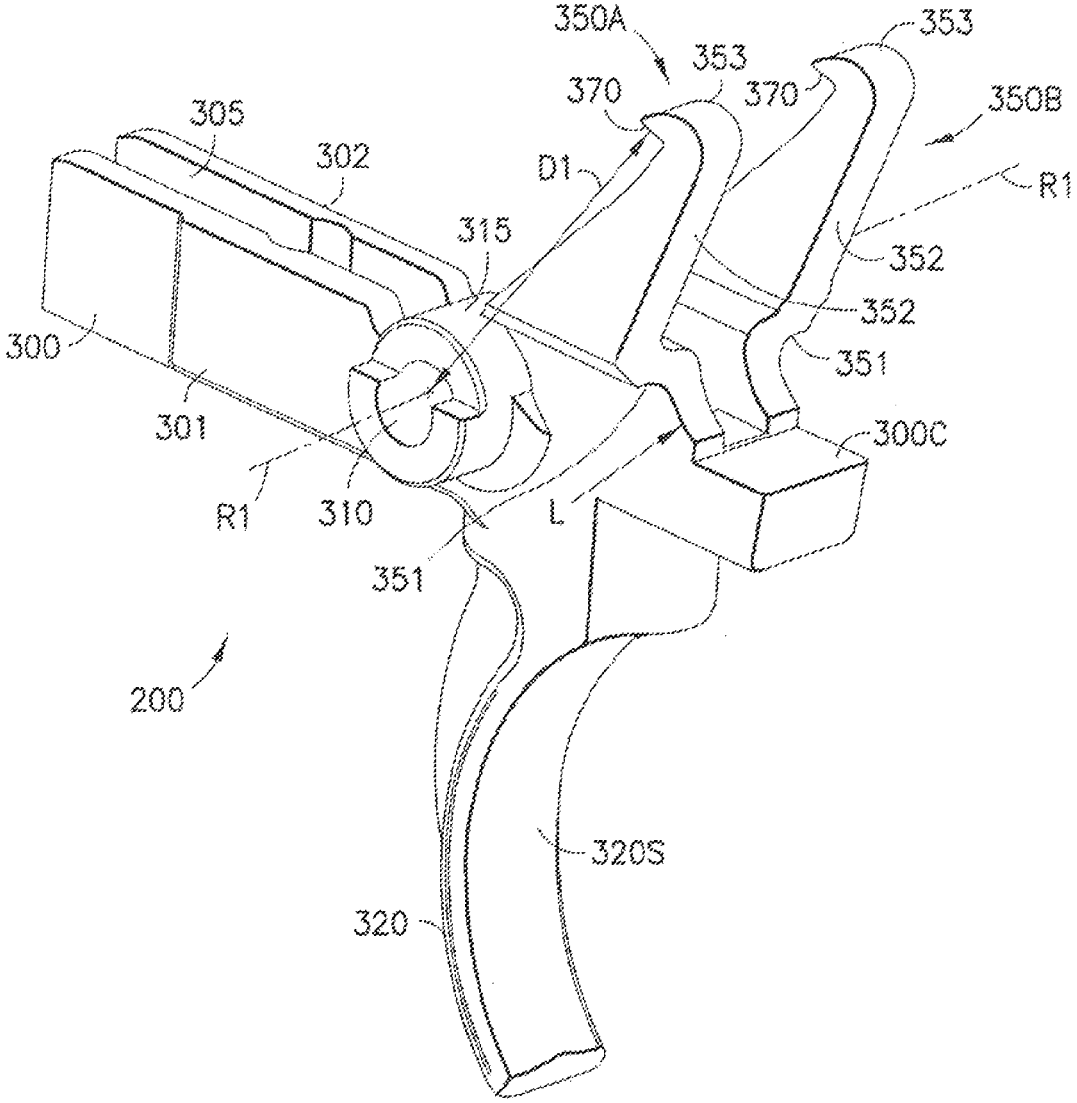
FIG. 3 is a schematic illustration of a portion of the fire control group in FIG. 2.

In this exemplary embodiment the trigger 200 is a single stage trigger. Referring to FIG. 3 the trigger 200 includes a frame 300, trigger hook 320 and one or more trigger sears 350A, 350B. The frame, trigger hook and the one or more sears 350A, 350B may be constructed of any suitable material (or combination of materials) in, for example, a one-piece or unitary construction. In alternate embodiments the parts of the trigger described herein may be constructed of separate components that are suitably joined together.

The frame 300 may have any suitable shape such as for example the longitudinally elongated shape shown in the Figs. The frame 300 includes an aperture 310 for allowing the trigger pin 250 to pass through the frame 300 for pivotally mounting the trigger 200 within the lower receiver 44. The aperture 310 is surrounded by a boss 315 that extends from both lateral sides 301, 302 of the frame 300. The boss 315 is configured to allow mounting of the trigger spring 200S to the frame 300. The frame 300 also includes a groove 305 in which the disconnect 210 (and disconnect spring—not shown) is inserted. The disconnect 210 may be pivotally secured within the frame 300 by the trigger pin 250 or any other suitable pin extending through the frame 300. A trigger pull member or a hook 320 extends away from the frame 300 and includes a trigger surface 320S for allowing a user to "squeeze" or "pull" the trigger 200 when the trigger 200 is installed within the lower receiver 44. The frame 300 may also include a cam surface 300C that engages the hammer 220 for allowing the disconnect 210 to engage a hook 420 of the hammer during, for example, semi-automatic use of the firearm 30 as will be described below.

In this exemplary embodiment, the trigger 200 includes one or more trigger sears 350A, 350B that extend from the frame 300. Here two trigger sears 350A, 350B are shown for exemplary purposes only. Each of the one or more trigger sears 350A, 350B includes a laterally extending portion 351, a leg or extension portion 352 extending from the laterally extending portion 351 and a hook portion 353 disposed on a distal end of the leg portion 352. The laterally extending portion 351 may extend any suitable length L from a respective lateral side 301, 302 of the frame 300 to allow suitable clearance for the leg portion 352 to extend along side the hammer 220 without, for example, interfering with the hammer spring (not shown). In alternate embodiments the hammer may be shaped to provide clearance between the one or more trigger sears 350A, 350B and the hammer (and hammer spring). In other alternate embodiments, for example, one trigger sear may be provided on the trigger frame and located on but one lateral side of the trigger frame, and the hammer may be arranged so that a clearance or lateral gap exists between the hammer and the trigger sear for unimpeded hammer motion when the trigger sear is disengaged. The leg portion 352 may extend from the laterally extending portion 351 any suitable distance so that the sear surface 370 of the hook portion 353 is located a predetermined distance D1 (FIG. 3) from a center of rotation R1 of the trigger 200 for substantially contacting a sear surface 401 of the hammer sear 400 as will be described below. It should be understood that while the trigger sears 350A, 350B are shown extending from a top of the trigger frame, in alternate embodiments the trigger sears 350A, 350B may extend from any suitable portion of the trigger frame such as for example, from a front of the frame or from a point adjacent the trigger hook. The predetermined distance D1 is configured to allow for increased rotational movement of the sear surface 370 for a given rotational movement of the trigger hook 320 (e.g. an arcuate distance traveled by the sear surface 370 is greater than an arcuate distance traveled by the trigger hook when compared to conventional triggers rotated by the same amount) so that, for example, the perceived trigger movement to release the hammer may be reduced or minimized. The predetermined distance D1 also allows for an increased overlap or engagement between the sear surface 370 of the trigger 200 and the sear surface 401 of the hammer when compared to the overlap between the sear surfaces of the hammer and trigger in conventional fire control systems. The increased distance of the sear surfaces 370, 401 from the hammer axis of rotation R2 may also reduce the frictional forces between the sear surfaces 370, 401 as the trigger hook 320 is squeezed.

Figure 4:
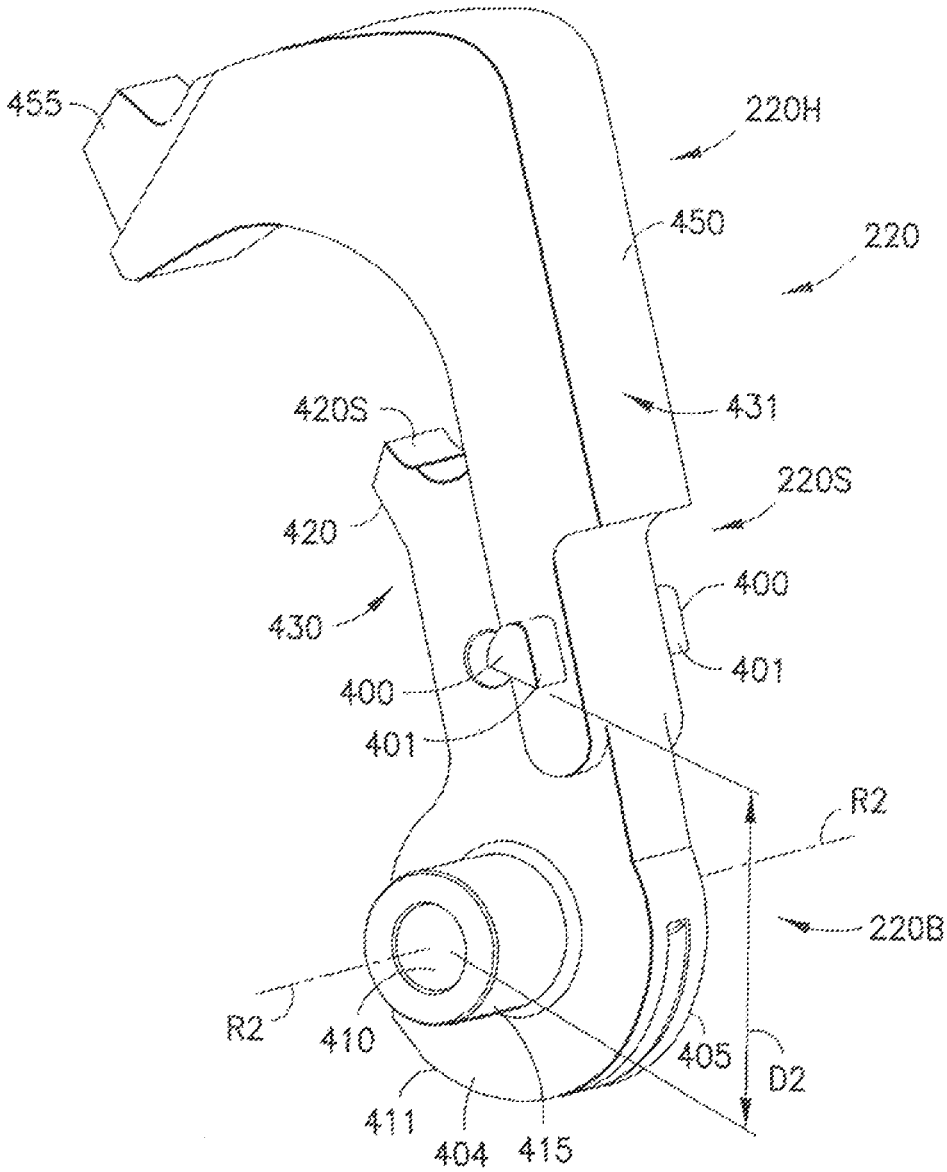
FIG. 4 is a schematic illustration of another portion of the fire control group in FIG. 2.

Referring to FIG. 4 the hammer 220 is shown in accordance with an exemplary embodiment and has a longitudinally extended shape. It should be understood that the hammer configuration described herein is exemplary only and in alternate embodiments the hammer may have any suitable features, shape and size. Here the hammer 220 includes a base 220B, a shaft 220 and a head 220H. The hammer 220 may be formed of any suitable material (or combination of materials) in a one-piece unitary construction. In alternate embodiments the hammer may be constructed of more than one piece joined together in any suitable manner. In this example, a boss 415 extends from both lateral sides 404, 405 of the base 220B and is substantially centered about an axis of rotation R2 of the hammer 220. The boss 415 provides a surface for allowing the hammer spring 599 (FIGS. 5A and 5B) to be mounted to the hammer 220. An aperture 410, also substantially centered about axis R2, extends through the boss 410 and is sized to allow the hammer pin 260 to pass through the base 220B for pivotally mounting the hammer 220 within the lower receiver 44. The base 220B the hammer may also include a camming surface 411 that interfaces with the cam surface 300C of the trigger frame 300 for holding the trigger frame 300 in a "pulled" position for allowing the disconnect 210 to engage a hammer hook 420 during semi-automatic operation of the firearm 30 as described below. It should be understood that the base 220B may include a notch N (FIG. 5A) to allow clearance between the trigger frame 300 and the base 220B so that the hammer may rotate forward, after for example, disengagement of the disconnect, for engaging the trigger and hammer sears as described below.

The shaft 220S extends longitudinally from the base 220B and includes the hammer hook 420 and one or more hammer sears 400. In this example, the hammer hook 420 extends from a back side 430 of the hammer 220 and includes a sear surface 420S for engaging a corresponding surface 210S of the disconnect 210. The hammer hook 420 cooperates with the disconnect 210 through the surfaces 420A, 210S to substantially prevent rotation of the hammer after the hammer has been cocked and while the trigger hook 320 is depressed after the firearm 30 has been fired, in for example the semi-automatic mode of operation, but before the trigger 200 has been released for resetting the trigger 200. As described above, when operating in a semi-automatic mode the camming surface 411 of the hammer 220 may hold the trigger frame 300 in a "pulled" or depressed position, after the hammer has been cocked, so that the disconnect 210 engages the hammer hook 420. Holding the trigger frame in the depressed position through the engagement of the cam surface 300C of the trigger and the camming surface 411 of the hammer 220 allows engagement of the disconnect 210 with the hammer hook 420 even if the trigger is released by an operator to substantially prevent discharge of the firearm 30 before the trigger is pulled or depressed subsequently to discharge the next round. As the hammer 220 rotates so that the cam surface 300C of the trigger frame 300 enters the notch N area of the hammer base 220B the trigger 200 is reset and the disconnect 210 disengages the hammer hook 420 for allowing the hammer sears 400 to engage a respective one of the trigger sears 350A, 350B.

The one or more hammer sears 400 include sear surface 401 and extend laterally away from a respective one of the lateral sides 404, 405 of the hammer 220. The one or more hammer sears 400 (two are shown for example purposes, in alternate embodiments there may be only one sear on a single lateral side of the hammer to cooperate with a trigger sear) are positioned on, for exemplary purposes only, the shaft 220S. In this example, the sear(s) 400 projects from a respective side of the hammer 220 so as to be offset from a hammer hook surface 420S (which engages the disconnect surface 210S). In alternate embodiments the hammer sear(s) may be formed in the side of the hammer 220. The sear surface 401 faces the direction of rotation of the hammer 220 when the hammer is released such that a substantially flat surface 450 disposed at a front 431 of the hammer 220 for striking a firing pin and the sear surface 401 face substantially the same direction. The sear surface 401 is located a predetermined distance D2 away from the axis of rotation R2 of the hammer 220. The distance D2 may be any suitable distance configured such that the sear surface 370 of the one or more trigger sears 350A, 350B substantially contact a respective one of the sear surfaces 401 when the hammer 220 and trigger 200 are mounted within the lower receiver 44. It is noted that while the hammer sears 400 are described as being located on the shaft 220S of the hammer 220 it should be understood that in alternate embodiments the hammer sears 400 may be located at any suitable position on the hammer 220 (e.g. the base 220B or head 220H) for engaging the extended trigger sears 350A, 350B described herein. It should also be realized that in alternate embodiments the trigger sears 350A, 350B may be correspondingly relocated on the frame 300 of the trigger 200 so they engage the one or more hammer sears 400 disposed on, for example, the base 220B or head 220H.

The head 220H of the hammer 220 extends from the shaft 220S. In this exemplary embodiment the head 220H is substantially "L" shaped but in alternate embodiments the head of the hammer may have any suitable shape. The head 220H includes the substantially flat surface 450 disposed at a front 431 of the hammer 220 for striking a firing pin of the firearm 30 when the hammer 220 is released from a cocked position. The head also includes a hammer auto-sear 455 for engaging the auto-sear 230 when the firearm is operated in the automatic mode.

Figure 5A:
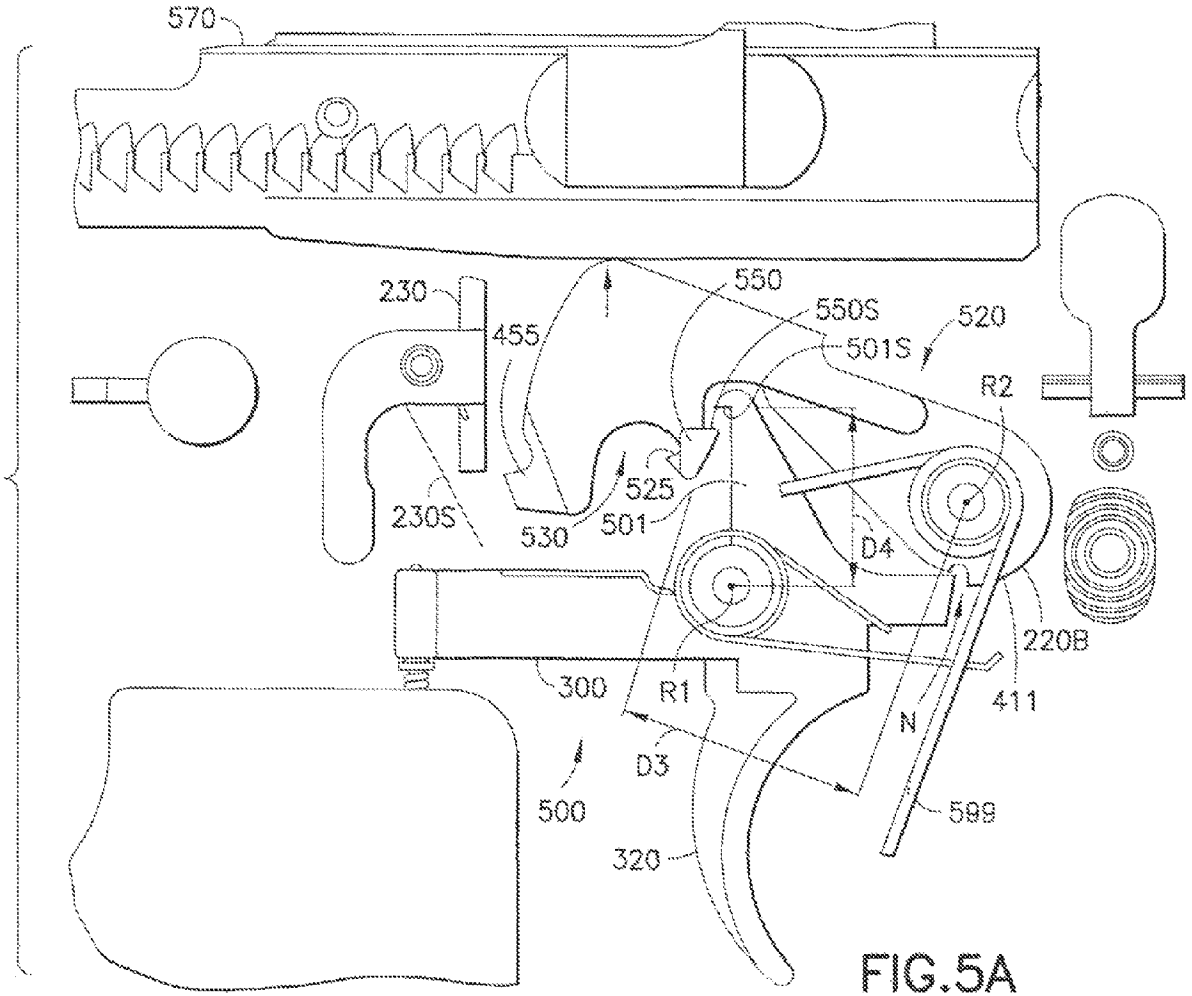
FIGS. 5A and 5B are schematic illustrations of a fire control group of the firearm in FIG. 1 in accordance with an exemplary embodiment.
Figure 5B:
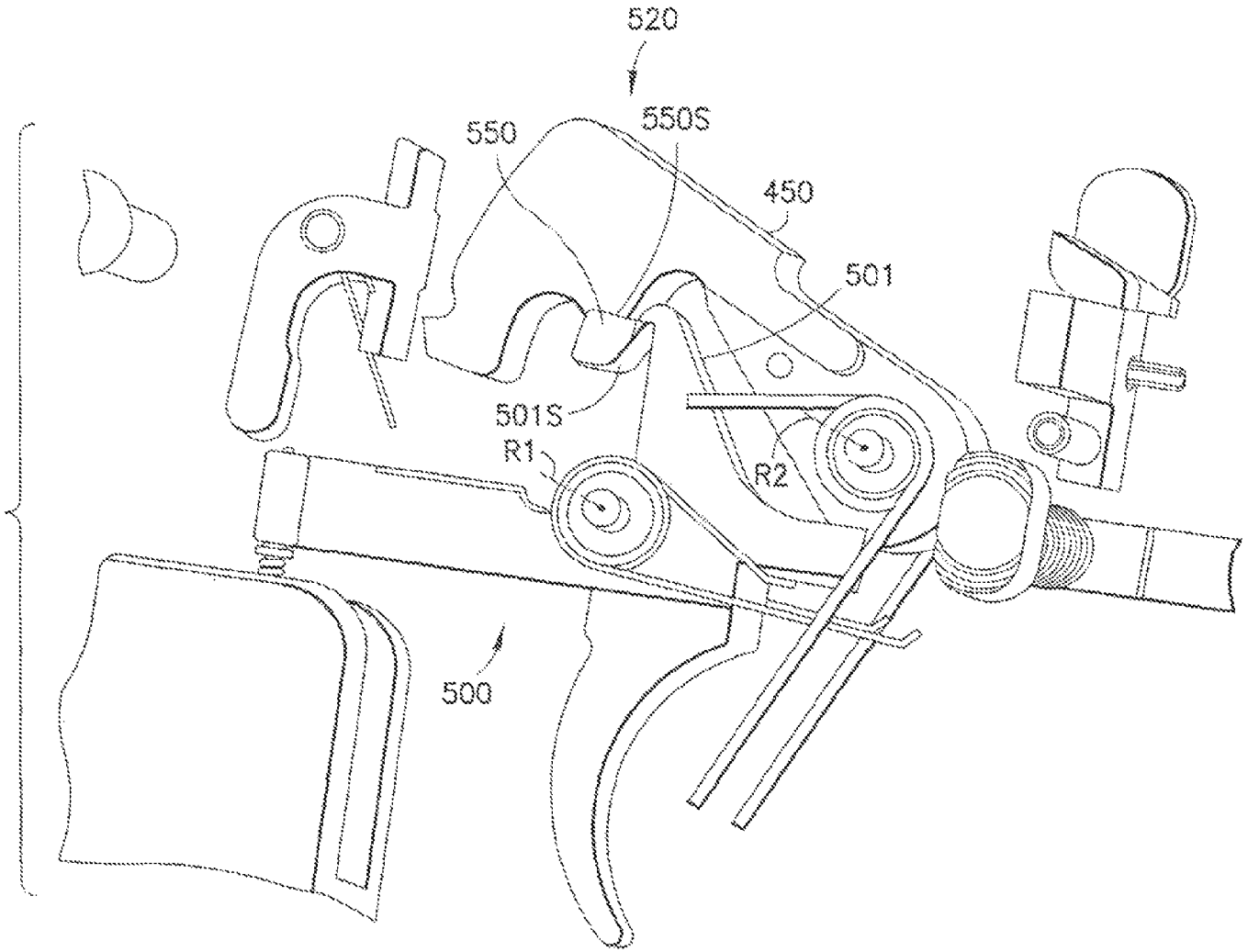

Referring now to FIGS. 5A and 5B a single stage trigger 500 and hammer 520 are shown in accordance with another exemplary embodiment. In FIG. 5A the hammer 520 is shown as being rotated into a cocked position by bolt carrier 570. FIG. 5B illustrates the hammer in the cocked position with the trigger and hammer sears 501, 550 engaged with each other. The trigger 500 and hammer 520 are substantially similar to trigger 200 and hammer 220 described above unless otherwise noted such that like features have like reference numerals.

For exemplary purposes only, in this example the trigger 500 has only one trigger sear 501. It should be understood that in alternate embodiments the trigger 500 may have more than one trigger sear. The trigger sear 501 is substantially similar to trigger sears 350A, 350B but extends from the trigger frame 300 at a different angle than trigger sears 350A, 350B to accommodate placement of the hammer sear 550 which is described below. The trigger sear 501 in this exemplary embodiment is positioned relative to the trigger frame 300 such that the trigger sear 501 does not interfere with the hammer spring. Because the trigger sear 501 is positioned to not interfere with the hammer spring the trigger sear 501 extends substantially in-line with the sides of the frame 300 (e.g. without a laterally extending portion as described above with respect to FIGS. 2 and 3). The trigger sear surface 501S may be located at a predetermined distance D4 from the center of rotation R1 of the trigger 500. The distance D4 is configured to increased rotational movement of the trigger sear surface 501S, increase overlap between the trigger and hammer sear surfaces 501S, 550S and reduce the perceived frictional forces between the sear surfaces 501S, 550S as described above with respect to trigger 200.

The hammer 520 is substantially similar to hammer 220, however in this exemplary embodiment the hammer hook 525 and hammer sear 550 are disposed on a back side 530 of the hammer head. In this example, the hammer sear 550 is disposed adjacent the hammer hook 525 such that the hammer sear is located a predetermined distance D3 from a center of rotation R2 of the hammer 520. The distance D3 may be any suitable distance such that the sear surface 5015 of the trigger sear 501 substantially contacts the sear surface 550S of the hammer sear 550 when the hammer 520 and trigger 500 are mounted within the lower receiver 44.

Figure 2:
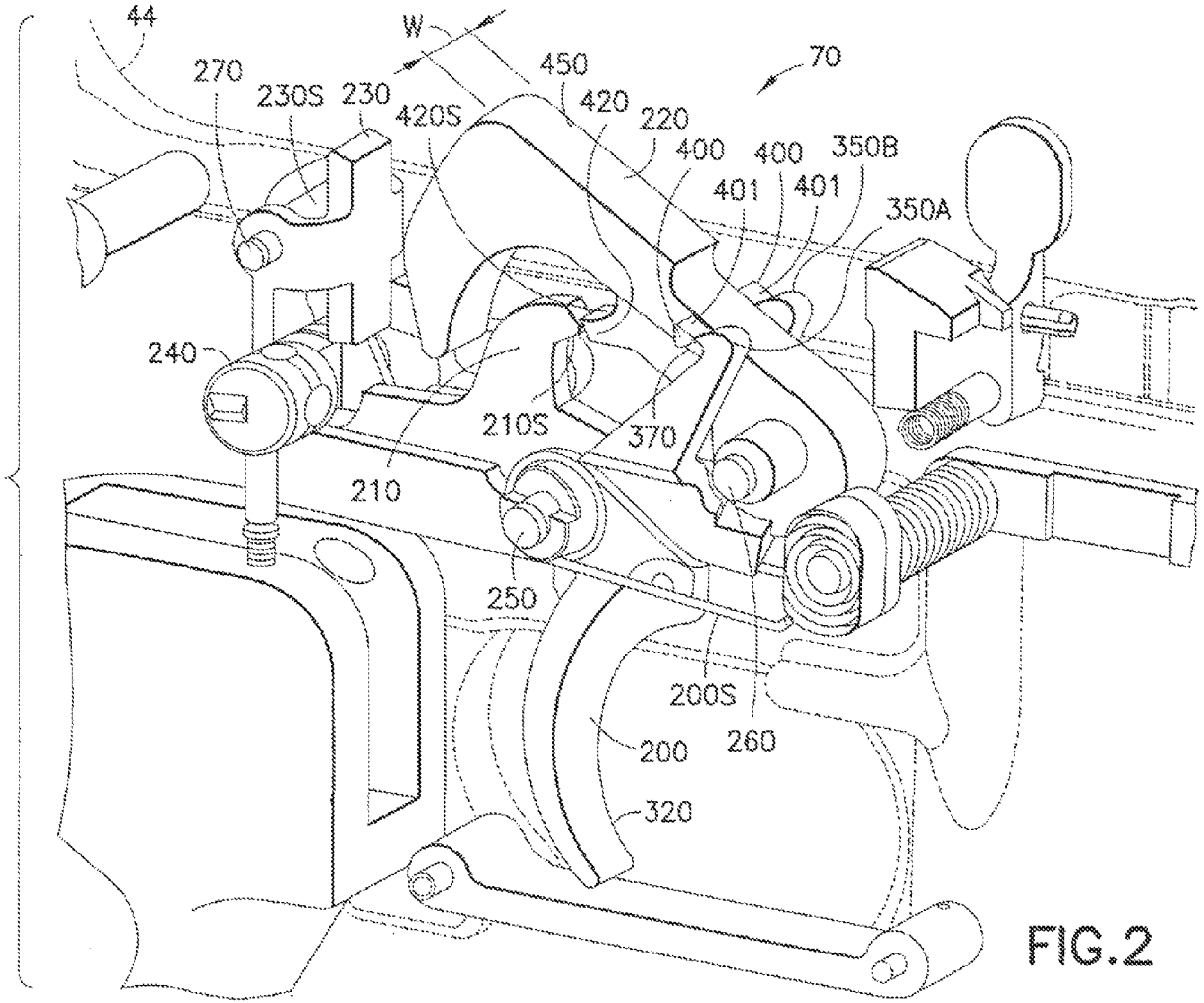
FIG. 2 is a schematic illustration of a fire control group of the firearm in FIG. 1 in accordance with an exemplary embodiment.

Referring again to FIGS. 1 and 2, operation of the fire control system 70 will be described, for exemplary purposes only, with respect to the semi-automatic mode of operation of the rifle 30. It should be understood that the trigger and hammer operate similarly to that described herein during automatic or burst operation of the firearm 30 with the exception of how the hammer is held in a cocked configuration after a projectile is fired from the firearm 30. When the hammer is in a cocked configuration as shown in FIG. 2, the hammer is released by squeezing or pulling the trigger hook 320 towards the rear 30R of the firearm 30 and against the force of the trigger spring 200S. As the trigger hook is pulled rearward, the trigger 200 rotates about trigger pin 250, which effects the rotation of the trigger sears 350A, 350B towards the front 30F of the firearm 30. The forward rotation of the trigger sears 350A, 350B causes trigger sear surface 370 to move relative to hammer sear surface 401 until trigger sear surface 370 disengages hammer sear surface 401. Upon disengagement of the sear surfaces 370, 401 the hammer 220 is released and is forced to rotate about hammer pin 260 towards the front 30F of the firearm 30 until the hammer surface 450 strikes the firing pin causing the firearm 30 to fire a projectile. The bolt unlocks from the barrel chamber and the bolt carrier travels towards the rear 30R of the firearm 30 causing the rearward rotation of the hammer 220 about hammer pin 260. The rearward rotation of the hammer 220 causes the hammer hook surface 420S to engage the disconnect surface 210S to hold the hammer in the rearward position during semi-automatic operation (in burst mode a burst mode disconnect (not shown) holds the hammer in a rearward position after the last round in the burst is fired and in automatic fire operation the auto-sear operates to hold the hammer in a rearward position until the bolt carrier effects disengagement of the auto-sear) while the bolt carrier travels forward and the bolt locks with the barrel chamber. The trigger hook 320 is released and the trigger spring forces the trigger 200 to rotate, such that the trigger sears 350A, 350B rotate rearward over the hammer sears 400. Further rotation of the trigger 200 disengages the hammer hook 420 from the disconnect 210 allowing forward rotation of the hammer such that the sear surfaces 370, 401 re-engage for holding the hammer 220 in a cocked configuration.

Figure 6:
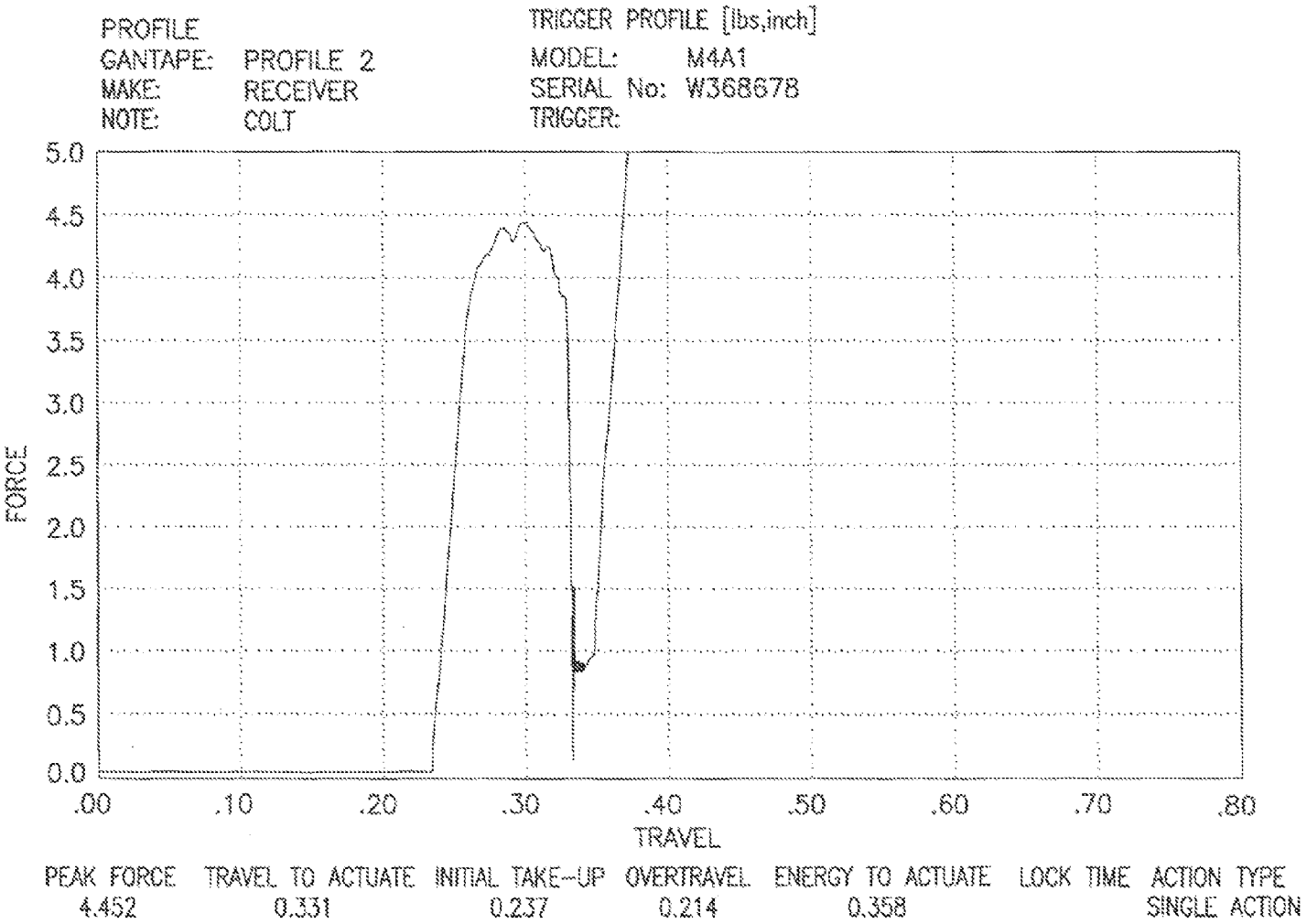
FIG. 6 is an exemplary graph illustrating trigger pull force in accordance with an exemplary embodiment.

FIG. 6 illustrates an exemplary graph showing the force needed to rotate the trigger hook 320 so that the hammer 220 is released in accordance with an exemplary embodiment of the single stage trigger 200. In this example, the peak force to release the hammer 220 is about 4.452 pounds. The energy to release the hammer is about 0.358 in-lb. The initial take up is about 0.214 inches and the travel to release the hammer is about 0.331 inches. Overtravel of the trigger 200 is about 0.214 inches.

Figure 7:
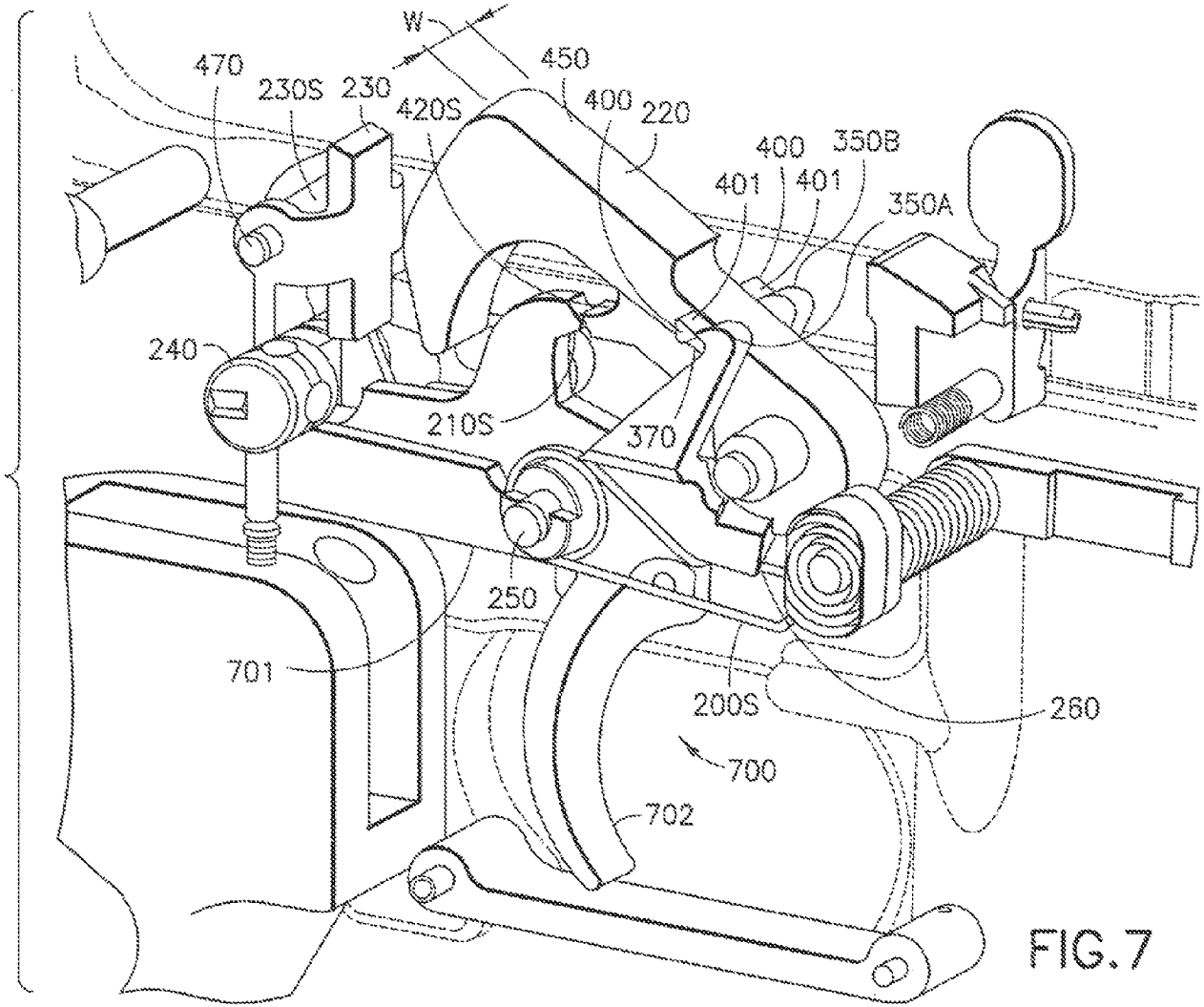
FIG. 7 is a schematic illustration of a fire control group of the firearm in FIG. 1 in accordance with an exemplary embodiment.
Figure 8A:
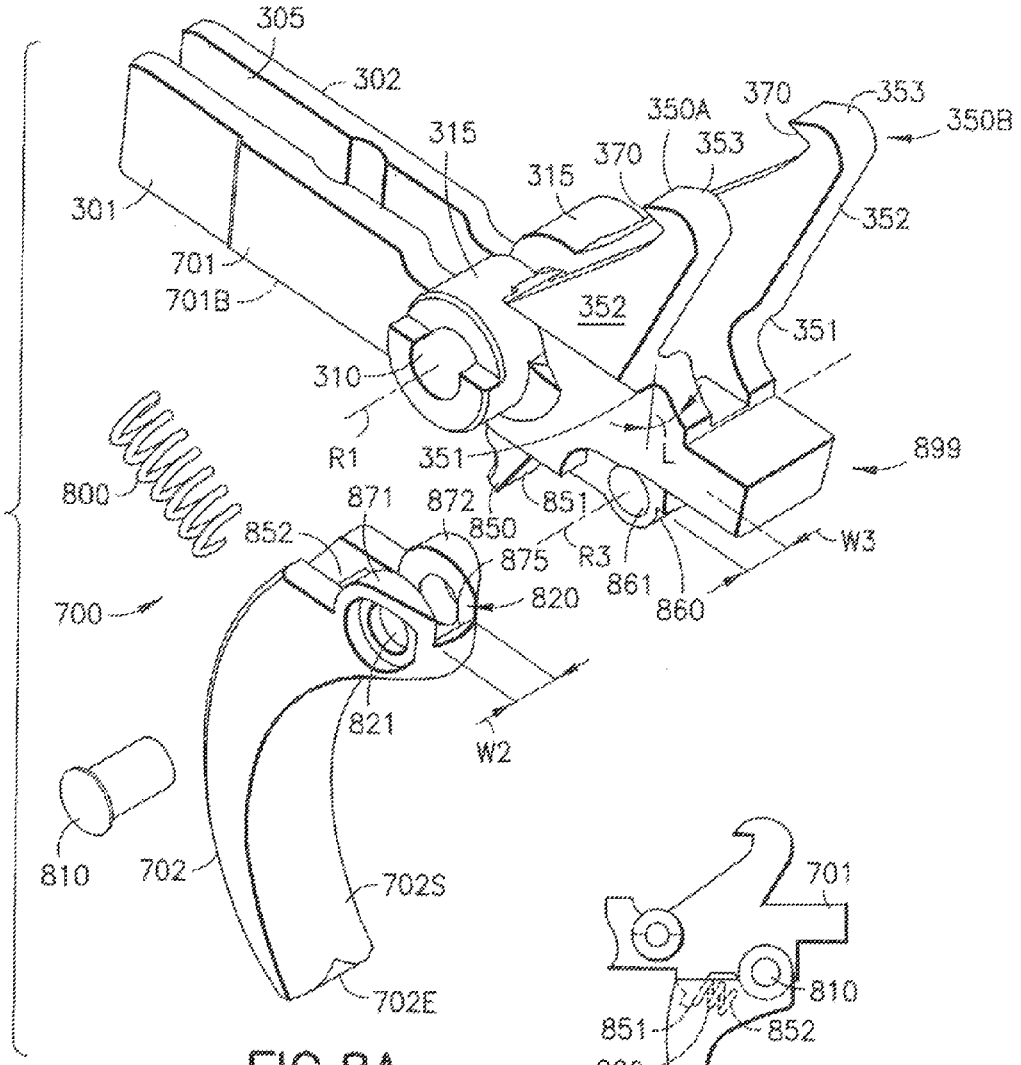
FIGS. 8A and 8B are a schematic illustrations of a portion of the fire control group in FIG. 7.

Referring now to FIGS. 7 and 8A another fire control group 770 is shown. The fire control group 770 is substantially similar to fire control group 70 described above such that similar features are similarly numbered. In this example, however, the trigger 700 is configured as a two-stage trigger. Here the trigger includes a longitudinally elongated trigger frame 701 and a trigger hook 702. The trigger frame 701 is substantially the same as the frame 300 but for the trigger hook 702 and corresponding trigger hook mounting features as will be described below.

In this example, the frame 701 includes rib 860 extending from, for example the bottom 701B of the frame 701. The rib includes an aperture 860 shaped and sized to allow a trigger hook pin 810 to be inserted into or through the rib 860. The frame 701 also includes a protrusion 850 having a surface 851. It should be understood that while the rib 860 and protrusion 850 are located substantially towards a front 899 of the frame 701, in alternate embodiments the rib 860 and/or protrusion 851 may be longitudinally located at any suitable position on the frame 701.

The trigger hook 702 includes a trigger surface 702S for allowing a user to "squeeze" or "pull" the trigger 700 when the trigger 700 is installed within the lower receiver 44. One end of the trigger hook 702 includes one or more slots 820 having a width W2 greater than a width W3 of the rib 860 and/or protrusion 850 such that the trigger hook 702 is allowed to pivot when mounted to the frame 701. The trigger hook 702 includes legs 871, 872, through which at least a portion of the slot extends to form the legs 871, 872. Each of the legs 871, 872 includes an aperture 821 sized and shaped to allow for the insertion of the trigger hook pin 810 through the trigger hook 702. A surface 852 is disposed within the slot 820.

Figure 8B:
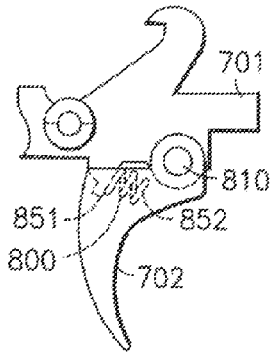

When assembled, referring also to FIG. 8B, a take-up spring 800 is positioned in the slot 820 so a first end of the spring substantially contacts surface 852 of the trigger hook 702 and a second end of the spring substantially contacts the surface 851 of the protrusion 850. The trigger hook pin 810 is inserted through the apertures 821 in the trigger hook 702 and the aperture 861 in the frame 701 for pivotally mounting the trigger hook 702 to the frame 701 about axis R3. The trigger hook pin 810 may be retained in the trigger 700 assembly in any suitable manner such as by for example, set screws, interference fits, or by one or more surfaces of the lower receiver 44. As may be realized, the take-up or boot spring 800 is captured within the trigger 700 assembly by the surfaces 852, 851 and the sides of the slot 820. The take-up spring 800 acts to push the trigger hook 702 so that end 702E of the trigger 702 pivots forwardly about axis of rotation R3 until stop surface 870 (or any other suitable surface) of the trigger hook 702 contacts a corresponding surface of the frame 701 for preventing further rotation of the trigger hook 702 about axis R3. When, for example, the stop surface 870 contacts the corresponding surface of the frame 701 the take-up spring 800 acts to hold the trigger hook 702 in an initial or reset position.

During operation of the two-stage trigger 700 the take-up spring 800 and the trigger spring 200S may act in series to divide the force needed to release the hammer 220 (e.g. trigger pull force) into two stages while maintaining a predetermined overall peak force needed to release the hammer 220. In this example, the first stage of trigger pull force is determined by the spring constant (or spring force) of the take-up spring 800. The second stage of trigger pull force is determined by the trigger spring 200S, however the perceived second stage trigger pull force is reduced by the take-up spring 800. For exemplary purposes only, if the desired peak trigger pull force for releasing the hammer is 4.5 pounds, the spring constant of the take-up spring 800 may be set so that the required force for the first stage of the trigger pull is 3.5 pounds leaving only an additional 1 pound of force that needs to be applied to the trigger hook 702 for releasing the hammer 220. As may be realized, adjusting the spring constant of the take-up spring 800 can increase or decrease the amount of force needed during the second stage of trigger pull for releasing the hammer 220 while maintaining the overall peak trigger pull force.

In operation force is applied to the trigger hook 702 by an operator. In the first stage of releasing the hammer 220 with the trigger 700, an initial force is applied to the trigger hook 702 to rotate the trigger hook 702 about axis R3 while the frame 701 remains substantially stationary. Rotation of the trigger hook 702 about axis R3 compresses the take-up spring 800. The trigger hook 702 may be rotated until the take-up spring 800 reaches its solid height or until a surface of the trigger hook 702 substantially contacts a corresponding surface of the frame 701 to provide a positive indication to a user that the first stage of the trigger 700 operation is complete. During the second stage of trigger 700 operation the user applies an additional force to the trigger hook 702 which causes the trigger spring 200S to compress allowing the frame 701 to rotate about axis R1. Rotation of the frame 701 causes trigger sears 350A, 350B to rotate about axis R1 for releasing the hammer 220 in a manner substantially similar to that described above with respect to trigger 200. During the second stage of trigger operation the interaction between the trigger and hammer is substantially similar to that described above with respect to single stage trigger 200 in that arcuate distance traveled by the sear surface 370 is greater than an arcuate distance traveled by the trigger hook 702 such that the movement of the trigger for releasing the hammer during the second stage is minimized. The trigger/hammer may also be reset in a manner substantially similar to that described above with respect to trigger 200 however, in this example, additional movement of trigger hook 702 may be needed to allow decompression of the take-up spring 800 for allowing the trigger hook 702 to return to its initial position.

Figure 9:
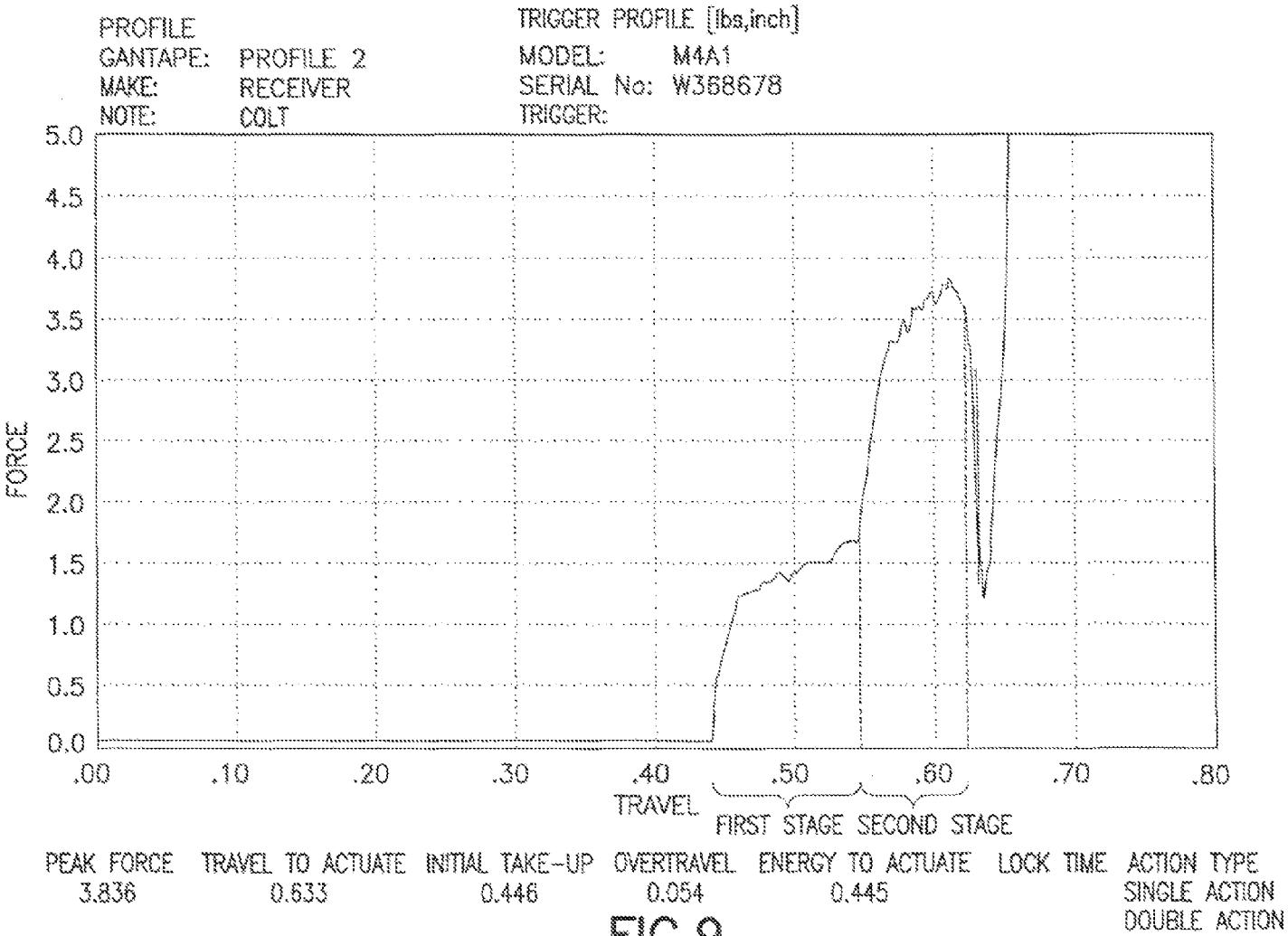
FIG. 9 is an exemplary graph illustrating trigger pull force in accordance with an exemplary embodiment.

FIG. 9 illustrates an exemplary graph showing the force needed to rotate the trigger hook 702 so that the hammer 220 is released in accordance with an exemplary embodiment of the two-stage trigger 700. In this example, the peak force to release the hammer is about 3.836 pounds. The energy to release the hammer is about 0.445 in-lb. The initial take up is about 0.446 inches and the travel to release the hammer is about 0.633 inches. Overtravel of the trigger 700 is about 0.054 inches. As can be seen in FIG. 9, in this example the first stage trigger pull is about 1.7 pounds.

Figure 10:
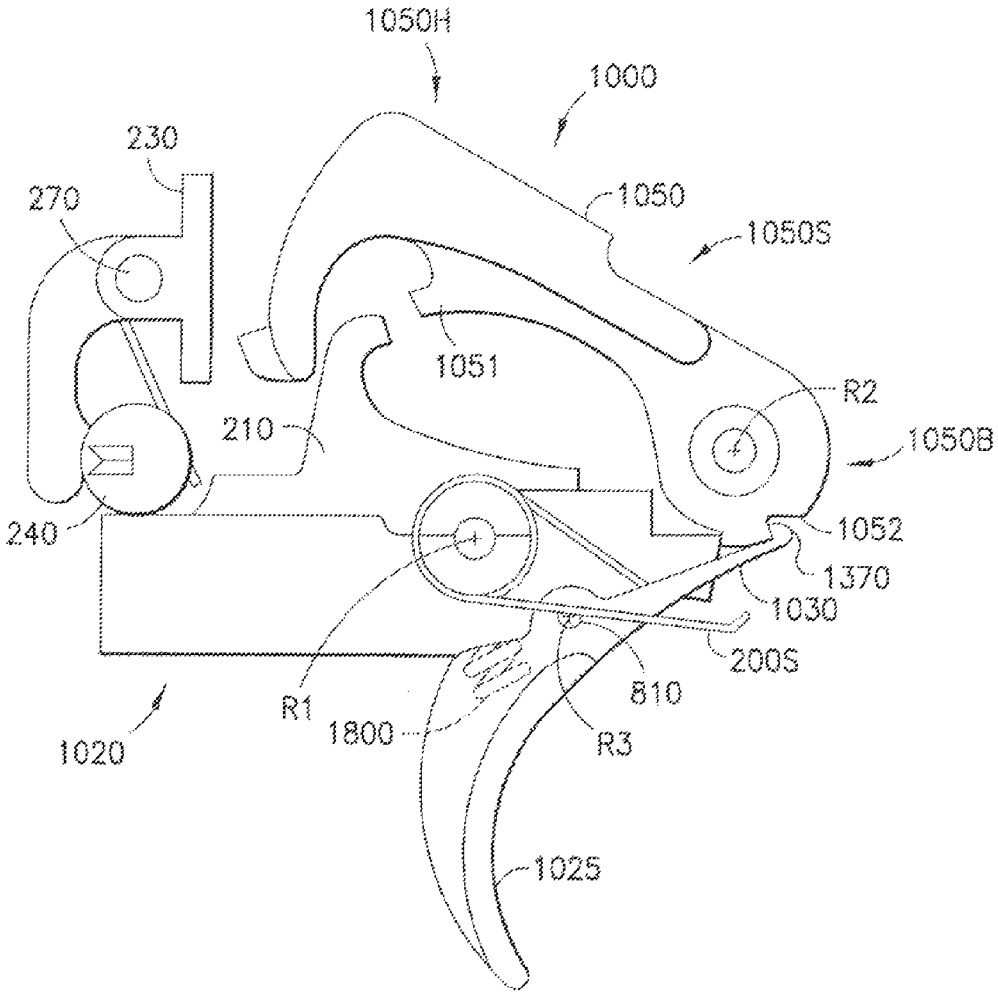
FIG. 10 illustrates an exemplary fire control group in accordance with another exemplary embodiment.

Referring to FIG. 10, another exemplary fire control group 1000 is shown. The fire control group may be substantially similar to fire control group described above with respect to FIGS. 7, 8A and 8B so that similar features are similarly numbered. In this exemplary embodiment the fire control group includes a hammer 1050 having a head 1050H, a shaft 1050S and a base 1050B. A hammer hook 1051 is disposed on a back surface of the hammer 1050 for engaging the disconnect 210 in a manner similar to that describe above. The base 1050B includes a sear engagement surface 1052 for engaging the sear 1030.

The trigger includes a frame 1020 and a trigger hook 1025 pivotally mounted to the frame about trigger hook pin 810. The frame may be substantially similar to frame 701 described above, but for the sears extending from the frame. The trigger hook 1025 may also be substantially similar to trigger hook 702. However, in this exemplary embodiment the trigger hook 1025 includes sear 1030 that extends from the trigger hook 1025 for engaging the surface 1052 of the hammer base 1050B. In one exemplary embodiment, the fire control group 1000 may be configured with a take-up or boot spring 1800, similar to spring 800, which may be held between the trigger hook 1025 and the frame 1020 in a manner substantially similar to that described above with respect to FIGS. 7, 8A and 8B for allowing a two-stage trigger operation. It should be understood that in alternate embodiments the trigger hook 1025 (and sear 1030) may be fixedly attached to the frame 1020 for providing a single stage trigger operation.

In operation force is applied to the trigger hook 1025 by an operator. In the first stage of releasing the hammer 1050 with the trigger, an initial force is applied to the trigger hook 1025 to rotate the trigger hook 1025 about axis R3 while the frame 1020 remains substantially stationary. Rotation of the trigger hook 1025 about axis R3 compresses the take-up spring 1800. The trigger hook 1025 may be rotated until the take-up spring 1800 reaches its solid height or until a surface of the trigger hook 1025 substantially contacts a corresponding surface of the frame 1020 to provide a positive indication to a user that the first stage of the trigger operation is complete. During the second stage of trigger operation the user applies an additional force to the trigger hook 1025 which causes the trigger spring 200S to compress allowing the frame 1020 to rotate about axis R1. Rotation of the frame 1020 allows trigger sear 1030 to rotate about axis R1 for disengaging surface 1052 and releasing the hammer 1050. During the second stage of trigger operation the interaction between the trigger and hammer is substantially similar to that described above with respect to single stage trigger 200 in that arcuate distance traveled by the sear surface 1370 is greater than an arcuate distance traveled by the trigger hook 1025 (at for example, the point on trigger hook that the force is applied) such that the movement of the trigger for releasing the hammer during the second stage is minimized. The trigger/hammer may also be reset in a manner substantially similar to that described above with respect to FIGS. 7, 8A and 8B.

It should be understood that the foregoing description is only illustrative of the embodiments.

Various alternatives and modifications can be devised by those skilled in the art without departing from the embodiments. Accordingly, the present embodiments are intended to embrace all such alternatives, modifications and variances that fall within the scope of the appended claims.

What is claimed is:

1. An automatic or semi-automatic firearm comprising:

a trigger having a frame;

at least one trigger sear extending from the frame; and a hammer having a hammer pivot axis, a striking surface and at least one hammer sear extending away from a lateral side of the hammer between the hammer pivot axis and the head in a direction parallel to an axis of rotation of the hammer, wherein and with respect to the hammer pivot axis, the at least one hammer sear extends away from the lateral side of the hammer prior to the striking surface extending from the hammer; wherein the frame includes a pivot axis and the at least one trigger sear includes a trigger sear surface, the at least one trigger sear extending from the frame such that the at least one trigger sear engages a corresponding one of the at least one hammer sear.

2. The automatic or semi-automatic firearm of claim 1, wherein the at least one trigger sear extends along a side of the hammer for engaging the corresponding one of the at least one hammer sear.

3. The automatic or semi-automatic firearm of claim 1, wherein the at least one trigger sear comprises two trigger sears configured to straddle the hammer for engaging the corresponding one of the at least one hammer sear.

4. The automatic or semi-automatic firearm of claim 1, further comprising a hammer hook configured to releasably engage a disconnect wherein the hammer hook extends away from another side of the hammer.

5. The automatic or semi-automatic firearm of claim 4, wherein the hammer hook extends in a direction offset from a direction the hammer sear extends away from the lateral side the hammer.

6. An automatic or semi-automatic firearm comprising:

a receiver; and a fire control group located at least in part within the receiver, the fire control group including a trigger having at least one trigger sear, a hammer having an elongated frame, a hammer pivot axis at one end and a striking surface at an opposite end and at least one hammer sear extending from a lateral side of the elongated frame between the hammer pivot axis and the striking surface in a direction parallel to an axis of rotation of the hammer, wherein the at least one hammer sear extends from the lateral side prior to the location of the striking surface on the hammer frame; wherein the at least one trigger sear extends along a portion of the lateral side of the hammer frame to engage a corresponding one of the at least one hammer sear.

7. The automatic or semiautomatic firearm of claim 6, wherein the trigger comprises a trigger frame and a trigger hook extending from the trigger frame, the trigger frame being pivotally coupled to the firearm.

8. The automatic or semi-automatic firearm of claim 6, further comprising a hammer hook configured to releasably engage a disconnect wherein the hammer hook extends away from another side of the hammer frame.

9. The automatic or semi-automatic firearm of claim 8, wherein the hammer hook extends in a direction offset from a direction the hammer sear extends away from the lateral side.

10. An automatic or semi-automatic firearm comprising:

a receiver; and a fire control group located at least in part within the receiver, the fire control group including a trigger having at least one trigger sear, a hammer having an elongated frame and at least one hammer sear extending from a lateral side of the elongated frame in a direction parallel to an axis of rotation of the hammer; wherein the at least one trigger sear extends along a portion of the lateral side of the hammer frame to engage a corresponding one of the at least one hammer sear, wherein the at least one hammer sear is a pair of hammer sears each extending away from opposite lateral sides of the hammer frame in the direction that is parallel to the axis of rotation of the hammer and the at least one trigger sear comprises two trigger sears configured to straddle the hammer for engaging a respective one of the pair of hammer sears.

11. The automatic or semiautomatic firearm of claim 10, wherein the trigger further comprises a trigger hook and the at least one trigger sear includes a sear surface, the trigger being configured such that during a given rotational movement of the sear surface, the sear surface travels a greater arcuate distance than a corresponding arcuate distance of the trigger hook.

12. An automatic or semi-automatic firearm, comprising:

a trigger having at least one trigger sear; and a hammer having an elongated frame, a hammer pivot axis, a striking surface and at least one hammer sear extending from a lateral side of the elongated frame between the hammer pivot axis and the striking surface in a direction parallel to an axis of rotation of the hammer, wherein the at least one hammer sear extends from the lateral side prior to the location of the striking surface on the elongated frame; wherein the at least one trigger sear extends along a portion of the lateral side of the hammer frame to engage the at least one hammer sear.

13. The automatic or semi-automatic firearm of claim 12, wherein the trigger further comprises a trigger hook and the at least one trigger sear includes a sear surface, the trigger being configured such that during a given rotational movement of the sear surface, the sear surface travels a greater arcuate distance than a corresponding arcuate distance of the trigger hook.

14. The automatic or semi-automatic firearm of claim 12, further comprising a hammer hook configured to releasably engage a disconnect wherein the hammer hook extends away from another side of the hammer frame.

15. The automatic or semi-automatic firearm of claim 14, wherein the hammer hook extends in a direction offset from a direction the hammer sear extends away from the lateral side.

* * * * *